United States Patent [19]

Dempster

[11] 4,119,266

[45] Oct. 10, 1978

[54] OCTAGONAL SHAPED PAPERBOARD BULK BIN

[75] Inventor: Thomas B. Dempster, Sioux City, Iowa

[73] Assignee: Champion International Corporation, Stamford, Conn.

[21] Appl. No.: 829,625

[22] Filed: Sep. 1, 1977

[51] Int. Cl.[2] ..... B65D 5/08

[52] U.S. Cl. ..... 229/39 R; 229/41 C

[58] Field of Search ..... 229/38, 39 R, 41 C

[56] References Cited

U.S. PATENT DOCUMENTS

| | | | |
|---|---|---|---|
| 241,409 | 5/1881 | Osborn | 229/39 R |
| 1,425,549 | 8/1922 | Scruby | 229/41 C UX |
| 2,565,188 | 8/1951 | Welshenbach | 229/39 R X |
| 2,674,400 | 4/1954 | Ross | 229/41 C UX |
| 2,844,296 | 7/1958 | Soja | 229/39 R |
| 3,527,399 | 9/1970 | Layne, Sr. | 229/39 R |
| 3,539,090 | 11/1970 | Blasdell | 229/38 |
| 3,945,558 | 3/1976 | Elder | 229/41 C |

*Primary Examiner*—Davis T. Moorhead
*Attorney, Agent, or Firm*—Evelyn M. Sommer

[57] ABSTRACT

An octagonal-shaped paperboard bulk bin particularly suited for use with heavy, palletized loads of meat products and the like is formed of alternating, upstanding side panels and corner panels, with each panel including a foldably connected bottom flap and with the bottom flaps being in overlapped and interengaged relationship to form the bottom wall of the bulk bin. More particularly, each corner panel includes a foldably connected, horizontally disposed rectangular flap which is initially folded inwardly such that each flap is in overlapping relationship. Each flap of one pair of flaps extending from opposed side panels is slotted to include two parallel slots disposed perpendicular to the fold line thereof, and extending for a distance corresponding to one-half of the width of the flap extending from the adjacent side panel. By this construction, the flaps extending from the side panels may be interengaged for forming a rigid bottom wall for the bulk bin.

6 Claims, 6 Drawing Figures

OCTAGONAL SHAPED PAPERBOARD BULK BIN

The subject invention relates to a new and improved paperboard bulk bin, and more particularly to a paperboard bulk bin of octagon shape made of a single blank which can be readily manufactured on a rotary slotter, without any die cutting equipment.

The subject invention is particularly concerned with a bin for relatively heavy, palletized loads, for example, large quantities of fresh meat, which are to be moved from place to place. In a centralized meat cutting operation involving the mechanized cutting, packaging, and shipment of large quantities of fresh meat, heavy duty bulk bins are required, and preferably heavy duty bulk bins that can be easily erected by a workman in a minimum amount of time. The resulting bulk bin should be rugged enough to withstand abuse during the handling and moving of the bin from place to place on pallets, and must be of sufficient strength to insure that it will not break apart or split when being transported.

In order to meet the desired objectives, the subject invention provides a new and improved paperboard bulk bin, which is preferably octagon-shaped and includes an upstanding side wall formed from first and second opposed pairs of side panels, and two pairs of corner panels. Each corner panel is disposed between one of the panels of each first and second pair of side panels, and foldably connected to each side and corner panel is a bottom flap portion. The four flaps extending from the corner panels are folded inwardly, preferably to an overlapped relationship. The flaps extending from the first pair of opposed side panels are substantially rectangular in configuration, while the flaps extending from the second pair of side panels are slotted, with the respective slots in said flaps being aligned to accept therebetween the flaps extending from the first pair of side panels. The interengagement of the flaps extending from the side panels, as well as the overlapping of the flaps from the corner panels provide a rigid bottom wall for the bulk bin. Furthermore, because of the configuration of the bottom wall of the subject bulk bin, the latter is readily erected by a single workman, without requiring the use of adhesives, staples, or other fastening means for maintaining the bottom wall in its erected condition.

The subject bulk bin is made from a single paperboard blank which is formed from a single wall or double wall corrugated board. Thus, the one-piece octagon bulk shipper of the subject invention can be manufactured on a rotary slotter, without and die cutting equipment. The subject bulk bin, having bottom flaps meeting in the center, eliminates the need of a bottom pad, as found in bulk bins of the prior art type. By eliminating the bottom pad, the subject invention achieves improved production time in manufacturing, and in addition, cuts down the inventory required by the bin manufacturer for the manufacture of the subject bulk bin. By virtue of the overlapping of the flaps in the bottom wall of the subject bulk bin, the weight of the product is distributed over the flaps in a more uniform manner as the applied pressure of the product bears against the bottom flaps and upstanding side walls of the subject bulk bin. Once the bottom wall of the subject bulk bin is formed, and in view of the locking feature of the bottom wall achieved by the interengagment of the flaps, the subject bulk bin will stay in its formed condition during transfer from the bulk bin set-up room to the loading area where the product is placed within the bulk bin.

The new and improved octagon shaped paperboard bulk bin of the subject invention, and the single blank for forming said bulk bin provide a bulk bin capable of handling heavy loads, which may be readily and economically manufactured as well as easily and rapidly erected by a single workman.

Further objects and advantages of the invention will become apparent from a reading of the following detailed description taken in conjunction with the drawings in which.

Figure 1:
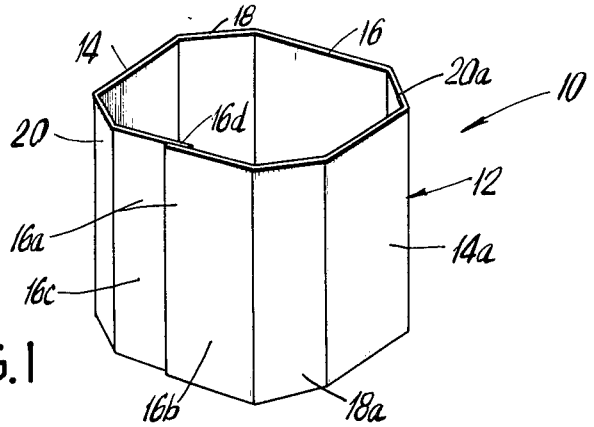
FIG. 1 is a perspective view of an erected octagon shaped paperboard bulk bin of the subject invention.
Figure 2:
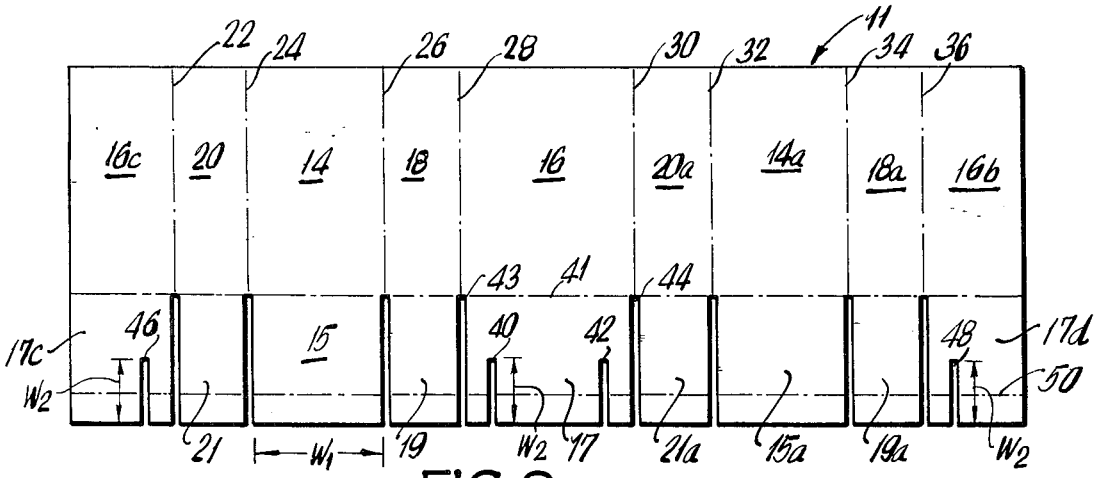
FIG. 2 is a plan view of the paperboard blank for forming the subject bulk bin.

Referring to FIGS. 1 and 2, the bulk bin of the subject invention is designated by the numeral 10, and is preferably made of a paperboard material, such as single wall or double wall corrugated board. The bulk bin is formed of a single blank 11 which is slotted and scored, as more fully described hereinafter. The bulk bin 10 includes upstanding side wall 12 and bottom wall 13 (see FIG. 5). The upstanding side wall 12 is of generally octagon configuration and basically comprises a first pair of opposed side panels 14, **14*a*, a second pair or opposed side panels 16, 16*a*, a first pair of opposed corner panels 18, 18*a* and a second pair of opposed corner panels 20, 20*a*. Each side and corner panel is substantially rectangular in configuration, with the side panel 16*a* being formed by two side wall portions 16*c* and 16*b* which are bonded along seam 16*d***. *Portion 16c* and **16*b* are bonded by means of a suitable adhesive, or alternatively, may be stapled together in order to complete the upstanding side wall 12 of the bulk bin 10. As shown in FIG. 2, each corner panel is disposed between one of the side panels so that the side panels and corner panels are alternatively arranged. Furthermore, the respective side and corner panels are hingedly connected along hinge lines designated by the numerals 22 through 36 inclusive. Extending from each side panel and corner panel and hingedly connected along fold line 41 thereto is a flap. More particularly, as shown in FIG. 2, extending from the corner panels 18 and 18*a* are flaps 19 and 19*a*, respectively. Likewise, extending from the corner panels 20 and 20*a* are flaps 21 and 21*a*. Flaps 19, 19*a* and 21, 21*a* are generally rectangular in configuration, and in the erected condition of the bulk bin are disposed generally horizontally, and in overlapped relationship, as shown in FIG. 6**.

Foldably connected to the lower edge of the first pair of opposed side panels 14 and **14*a* are rectangular flaps 15 and 15*a*. The width of each flap 15, 15*a* is designated by the letter $W_1$. Foldably connected to the side panel 16 of the second pair of opposed side panels is slotted flap 17. Flap 17 includes slots 40, 42, each of which extends from the free edge of the flap 17 and generally perpendicular to the fold line 41 for a distance designated by the letter $W_2$. The length of $W_2$ is equal to or slightly greater than one-half of the width $W_1$ of flaps 15 and 15*a*. In addition, preferably the slots 40 and 42 are located closer to the opposed side edges of the flap 17. For example, if the total width of flap 17 is approximately 30 inches then slots 40 and 42 would be located approximately 5–½ inches from the respective side edges 43, 44 of the flap 17**.

In like manner, each side panel portion 16*c* and 16*b* includes a foldably connected bottom flap 17*c* and 17*d*, respectively. Bottom flaps 17*c* and 17*d* include a slot 46, 48, respectively, each of which extends for a distance $W_2$ corresponding to or slightly greater than the width $W_1$ of the flaps 15, 15*a*. As also shown in FIG. 2, a single score line 50 extends across all of the flaps, closer to the free edge thereof. In the erection of the subject bulk bin, first the blank 11 is folded about the fold lines 22 through 26, and side wall panels 16*c* and 16*b* are bonded along seam 16*d*.

Figure 3:
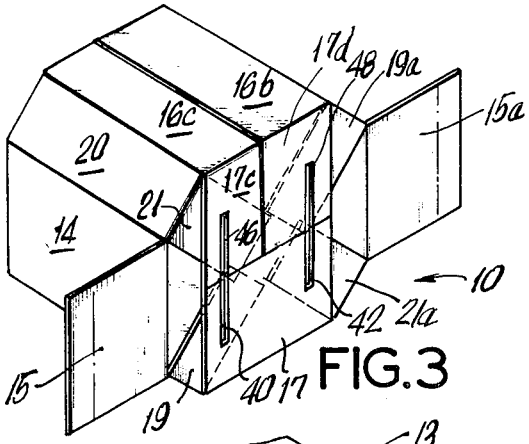
FIGS. 3 through 5 are perspective views in sequence of the erection of the bottom wall of the subject bulk bin.
Figure 4:
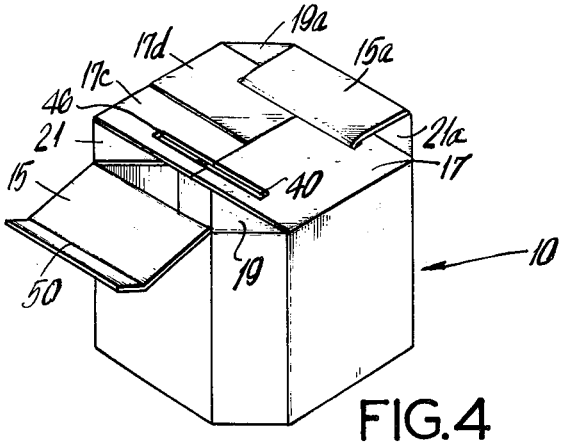
Figure 5:
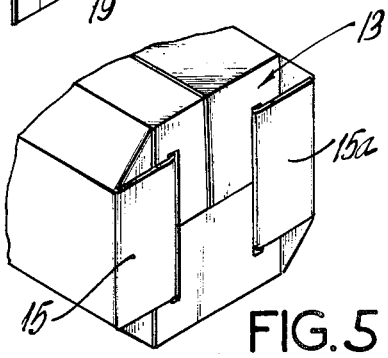
Figure 6:
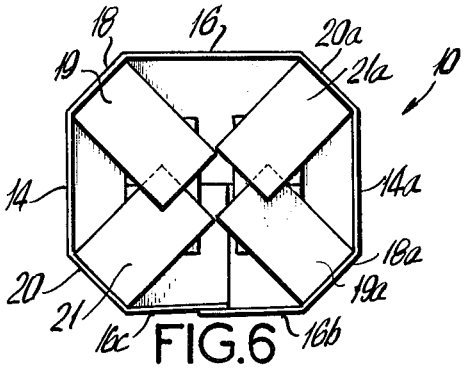
FIG. 6 is a top plan view of the erected bulk bin of the subject invention.

FIGS. 3 through 5 illustrate in sequence the assembly of the bottom wall of the bulk bin 10. Referring first to FIG. 3, initially the four flaps 21, 19, 21*a*, 19*a* extending from the corner panels are folded inwardly so as to be wholly disposed within the resulting bulk bin 10. As shown in FIG. 6, preferably flaps 21, 21*a*, 19, 19*a* are suitably dimensioned so as to result in an overlapping relationship.

As also shown in FIG. 3, next the slotted flaps 17 and 17*c*–17*d* are folded about the fold line 41, with the slots 40 and 46, and 42 and 48 being aligned and cooperating so as to form elongated slots of a width corresponding to twice the distance $W_2$. As indicated above, twice the distance $W_2$ will equal or be slightly greater than the width $W_1$ of the flaps 15 and 15*a*. Referring to FIGS. 4 and 5, in the completion of the erection of the bulk bin 10, the flaps 15 and 15*a* are initially folded about the fold line or the score line 50, and the free ends thereof are inserted through the aligned apertures 42–48 and 40–46 so as to result in the locking interengagment of the flaps extending from the side panels. The resulting bottom wall construction provides an overlapping arrangement of flaps which, because of the interengagment of certain flaps thereof, provides a sturdy bottom wall which is readily erected by a single workman.

Accordingly, there is provided new and improved bulk bin which is formed of a single blank, and which is economical to manufacture and can be readily manufactured on a rotary slotter without any die cutting equipment. In addition, the resulting subject bulk bin is formed of a single blank, thereby eliminating the need for a bottom pad, as found in prior art bulk bins.

The subject invention, and many of its intended advantages will be understood from the foregoing description, and it will be apparent that various changes may be made in the form and construction of the subject bulk bin without departing from the spirit and scope of the invention as defined by the following claims.

What is claimed is:

1. An octagonal-shaped paperboard bulk bin comprising:

a side wall formed from first and second opposed pairs of substantially rectangular, upstanding side panels and first and second opposed pairs of substantially rectangular, upstanding corner panels that are alternatively, foldably connected, said side panels being of greater width than said corner panels, and with each corner panel including a horizontally disposed, substantially rectangular flap foldably connected to the bottom edge thereof, each side panel of said first pair of opposed side panels including a horizontally disposed, substantially rectangular flap foldably connected to the bottom edge thereof, each side panel of said second opposed pair of side panels having a horizontally disposed, substantially rectangular slotted flap, each slotted flap including two parallel slots disposed perpendicular to the fold line thereof and extending from the edge thereof opposite said fold line for a distance corresponding to approximately one-half the width of each flap of said first pair of opposed side panels whereby with the flaps extending from said corner panels overlapping one another and being wholly disposed within the bulk bin, and with the flaps extending from said first pair of opposed side panels extending through the slots formed in said slotted flaps for engagement with said slotted flaps, a bottom wall for the bulk bin is formed.

2. An octagonal-shaped paperboard bulk bin as in claim 1 wherein said bin is formed from a single wall corrugated board.

3. A paperboard blank for a bulk bin comprising:

a side wall formed from first and second opposed pairs of substantially rectangular side panels and first and second opposed pairs of substantially rectangular corner panels that are alternatively, foldably connected, said side panels being of greater width than said corner panels, and with each corner panel including a substantially rectangular flap foldably connected to the bottom edge thereof, each side panel of said first pair of opposed side panels including a substantially rectangular flap foldably connected to the bottom edge thereof, each side panel of said second opposed pair of side panels having a substantially rectangular slotted flap, each slotted flap including two parallel slots disposed perpendicular to the fold line thereof and extending from the edge thereof opposite said fold line for a distance corresponding to approximately one-half the width of each flap of said first pair of opposed side panels whereby the flaps extending from said corner panels overlap one another and are wholly disposed within an erected bulk bin, and wherein the flaps extending from said first pair of opposed side panels extend through the slots formed in said slotted flaps for engagement with said slotted flaps in an erected bulk bin to provide a bottom wall for the bulk bin.

4. A paperboard blank for a bulk bin as in claim 3 wherein said blank is formed from a single wall corrugated wall.

5. An octagonal-shaped paperboard bulk bin as in claim 1 wherein said bin is formed from a double wall corrugated board.

6. A paperboard blank for a bulk bin as in claim 3 wherein said blank is formed from a double wall corrugated wall.

* * * * *